US005876314A

United States Patent [19]

Sugimura

[11] Patent Number: 5,876,314

[45] Date of Patent: Mar. 2, 1999

[54] HEALTH IMPROVING GYMNASTIC APPARATUS

[75] Inventor: Masahiro Sugimura, Osaka, Japan

[73] Assignee: Sancrystal Co., Ltd., Osaka, Japan

[21] Appl. No.: 936,630

[22] Filed: Sep. 23, 1997

[30] Foreign Application Priority Data

Sep. 25, 1996 [JP] Japan ..... 8-252520

[51] Int. Cl.[6] ..... A63B 19/04; A61H 1/02

[52] U.S. Cl. ..... 482/144; 606/244

[58] Field of Search ..... 482/144, 79, 80; 606/261, 242, 244; 472/16, 17, 18

[56] References Cited

U.S. PATENT DOCUMENTS

| | | | |
|---|---|---|---|
| Re. 16,653 | 10/1927 | Evins | 606/244 |
| 3,152,802 | 10/1961 | Heisler | 482/144 |
| 3,568,669 | 3/1971 | Stites | 606/244 |
| 3,589,358 | 6/1971 | Meanl | 482/144 X |
| 4,113,250 | 9/1978 | Davis | 482/144 |
| 4,214,790 | 7/1980 | Sieber | 482/144 X |
| 4,360,009 | 11/1982 | Weisman | 606/244 |
| 4,419,989 | 12/1983 | Herbold | 482/144 X |
| 5,695,438 | 12/1997 | Bjornsti | 482/144 |
| 5,718,660 | 2/1998 | Chen | 482/144 |

FOREIGN PATENT DOCUMENTS

WO 94/09853 5/1994 WIPO .

*Primary Examiner*—Richard J. Apley
*Assistant Examiner*—William LaMarca
*Attorney, Agent, or Firm*—Nikaido Marmelstein Murray & Oram, LLP

[57] ABSTRACT

A health improving gymnastic apparatus comprises a fixed frame, a carrier for carrying a body of a user, a rotary handle to be operated by the user getting on the carrier, and a power transmission mechanism. The carrier is provided with a foot holding unit to hold feet of the user. The carrier is rotatably supported by the fixed frame to give a rotary motion about a horizontal axis relative to the fixed frame between a standing position, where the user stands upright with one's feet held by the foot holding unit, and an upside-down position, where the user is suspended one's head down with one's feet held by the foot holding unit. The rotary handle is mounted on the carrier to give a rotary motion about a handle axis. The power transmission mechanism transmits the rotary motion of the rotary handle to the rotary motion of the carrier relative to the fixed frame. The gymnastic apparatus brings about an advantage that the user getting on the carrier can readily and safely obtain the upside-down position all by oneself without help of others.

5 Claims, 9 Drawing Sheets

HEALTH IMPROVING GYMNASTIC APPARATUS

BACKGROUND OF THE INVENTION

1. Field of the Invention

The present invention relates to a health improving gymnastic apparatus characterized in that a user can readily and safely take an upside-down state, where the user is suspended upside down by the gymnastic apparatus, all by oneself without help of others.

2. Disclosure of the Prior Art

A gymnastic apparatus having an iron bar for allowing a user to hang therefrom is utilized to release various stresses loaded to joints of the user by terrestrial gravitation, and to refresh a mental fatigue. In addition, the gymnastic apparatus is useful to stretch a spine, or lumbar vertebra of the user. Therefore, the gymnastic apparatus would be useful to improve health of the user.

By the way, when an exerciser stands on one's head, it is possible to stretch wrinkles and loose skin, and refresh a mental fatigue. However, there is a disadvantage that a large amount of weight is loaded to joints of shoulder and arms of the exerciser. In addition, an assistant may be usually needed to keep the exerciser in the state of standing on one's head for a required time period.

SUMMARY OF THE INVENTION

A primary object of the present invention is to provide a health improving gymnastic apparatus characterized in that a user can readily and safely take an upside-down state, where the user is suspended upside down by the gymnastic apparatus, all by oneself without help of assistant. That is, the gymnastic apparatus comprises a fixed frame, a carrier for carrying a body of a user, a rotary handle to be operated by the user getting on the carrier, and a power transmission mechanism. The carrier is provided with a foot holding unit to hold feet of the user. The carrier is rotatably supported by the fixed frame to give a rotary motion about a horizontal axis relative to the fixed frame between a standing position, where the user stands upright with one's feet held by the foot holding unit, and an upside-down position, where the user is suspended one's head down with one's feet held by the foot holding means. The rotary handle is mounted on the carrier to give a rotary motion about a handle axis. The power transmission mechanism transmits the rotary motion of the rotary handle to the rotary motion of the carrier relative to the fixed frame.

It is preferred that the power transmission mechanism comprises a speed reduction unit which transmits the rotary motion of the rotary handle to a reduced rotary motion of the carrier.

It is further preferred that the rotary handle is in the form of a crank shaft which gives the rotary motion by a boating-like exercise by the user.

It is also preferred that the fixed frame is formed in a three-dimensional structure such that a rotational locus of the carrier is within the fixed frame. This provides a safe rotary motion of the carrier.

These and still other objects and advantages will become apparent from the following description of the preferred embodiments of the invention when taken in conjunction with the attached drawings.

DETAILED EXPLANATION OF THE PREFERRED EMBODIMENT

A health improving gymnastic apparatus 1 of the present invention is explained in detail, referring to the attached drawings.

Figure 1:
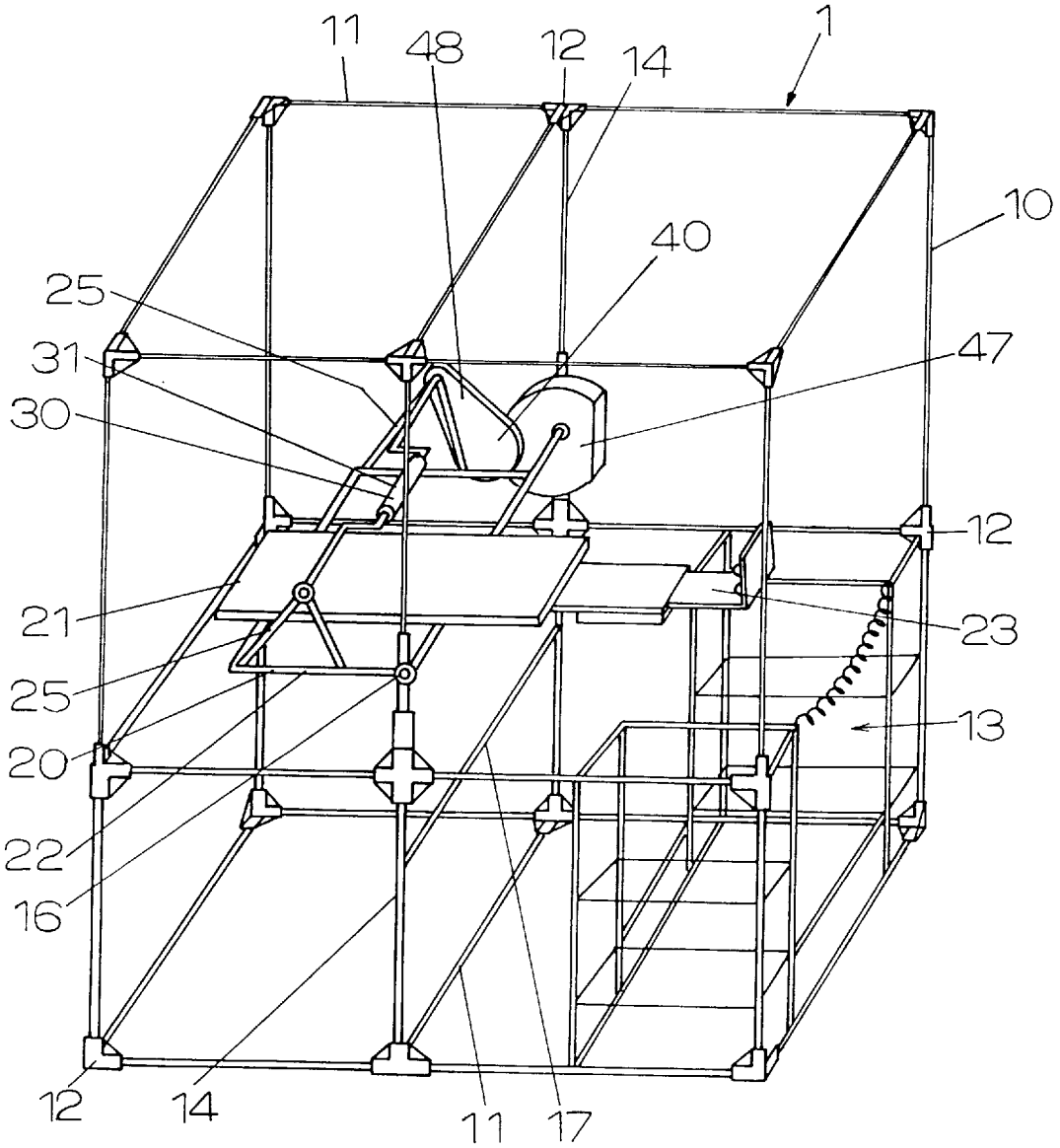
FIG. 1 is a perspective view of a health improving gymnastic apparatus of the present invention.
Figure 2:
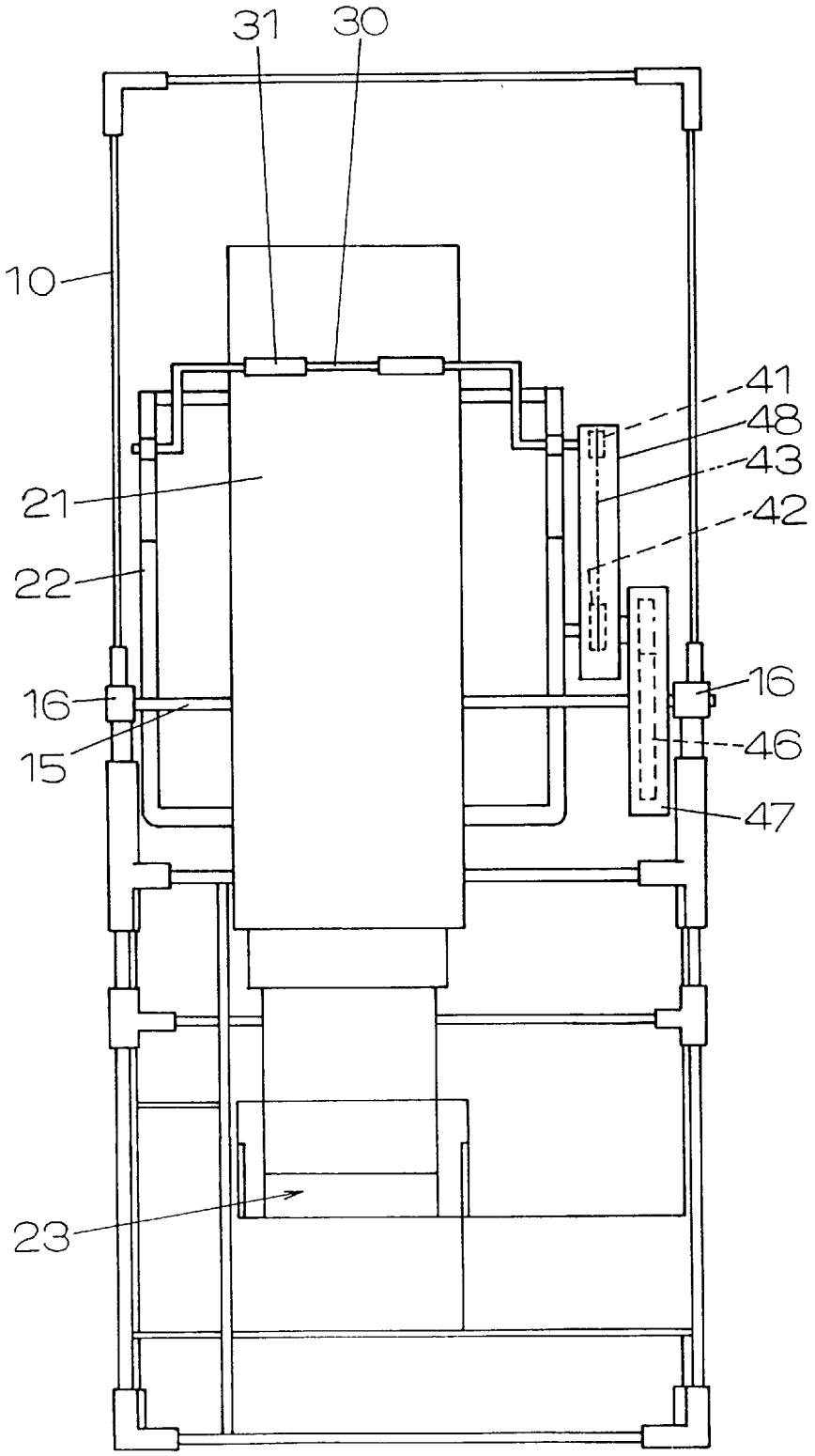
FIG. 2 is a front view of the gymnastic apparatus.
Figure 3:
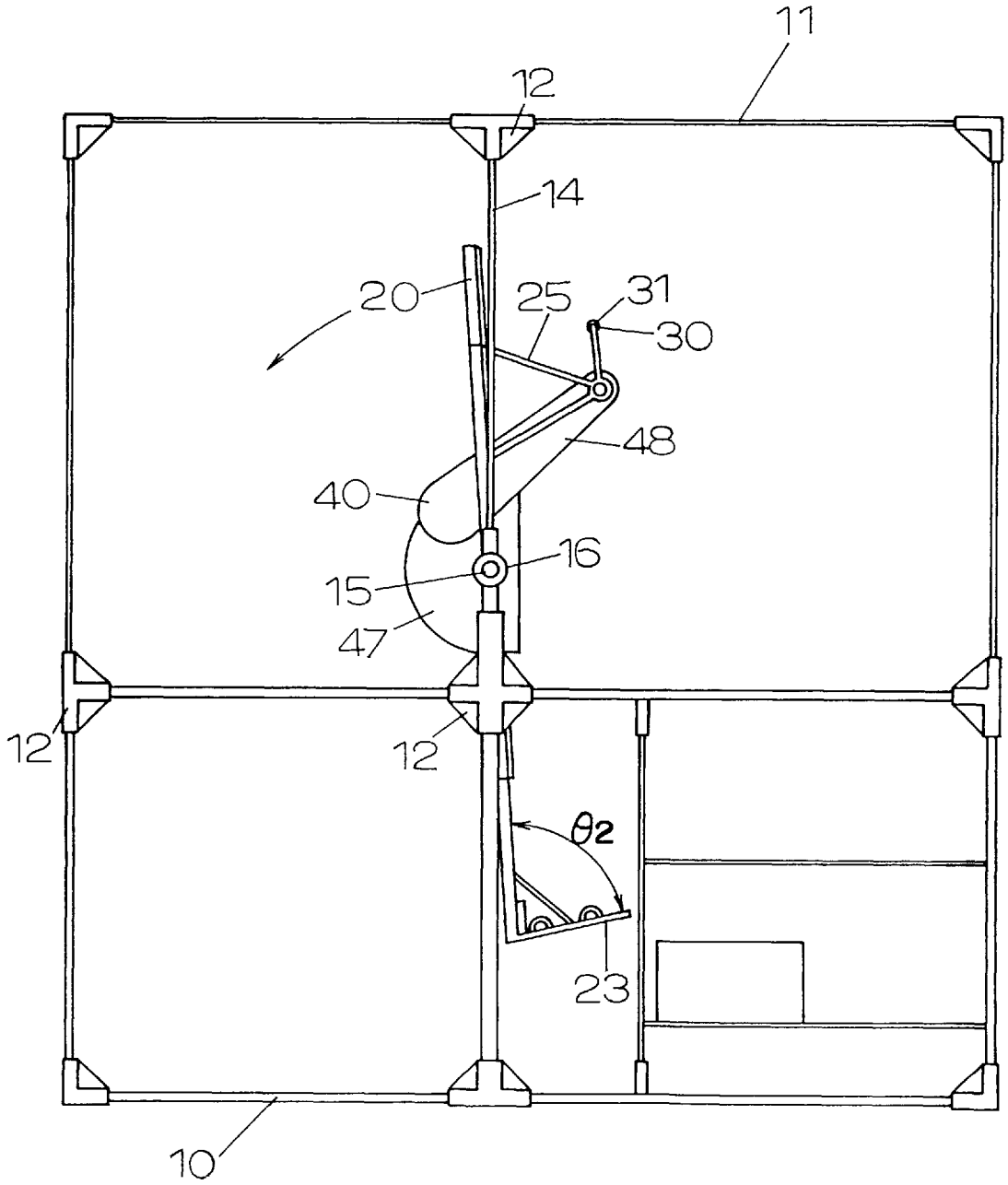
FIG. 3 is a side view of the gymnastic apparatus.
Figure 4:
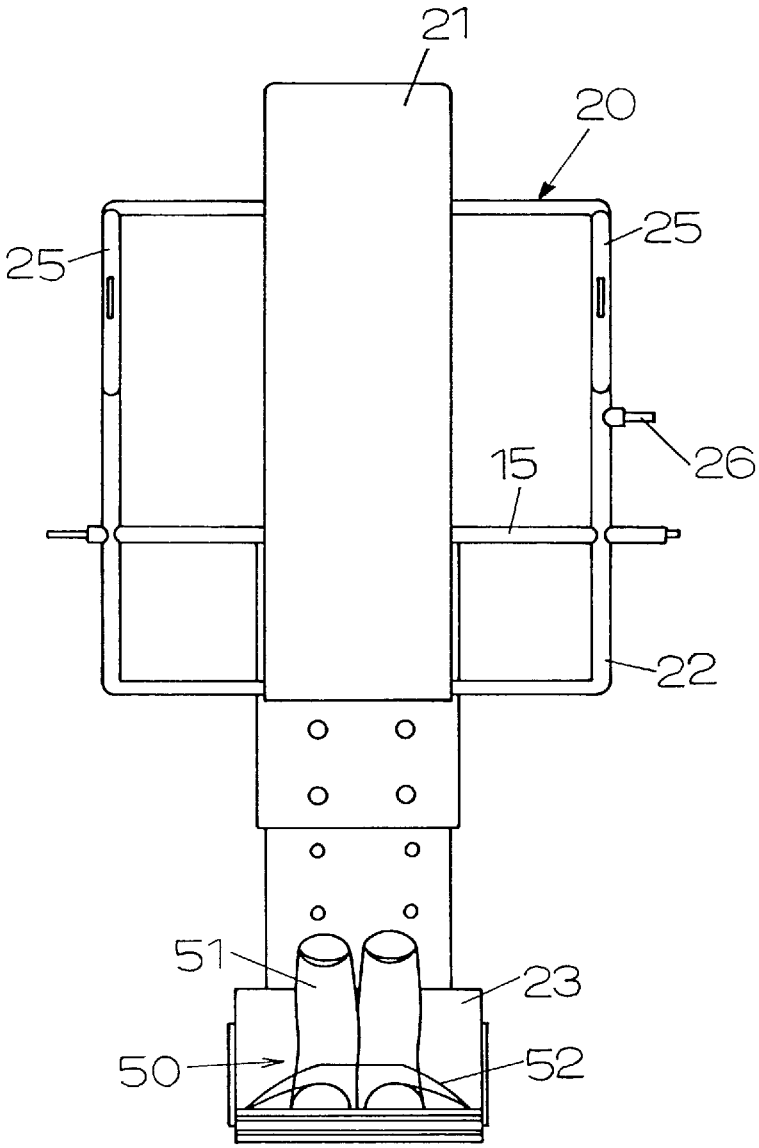
FIG. 4 is a front view of a carrier of the gymnastic apparatus.
Figure 5:
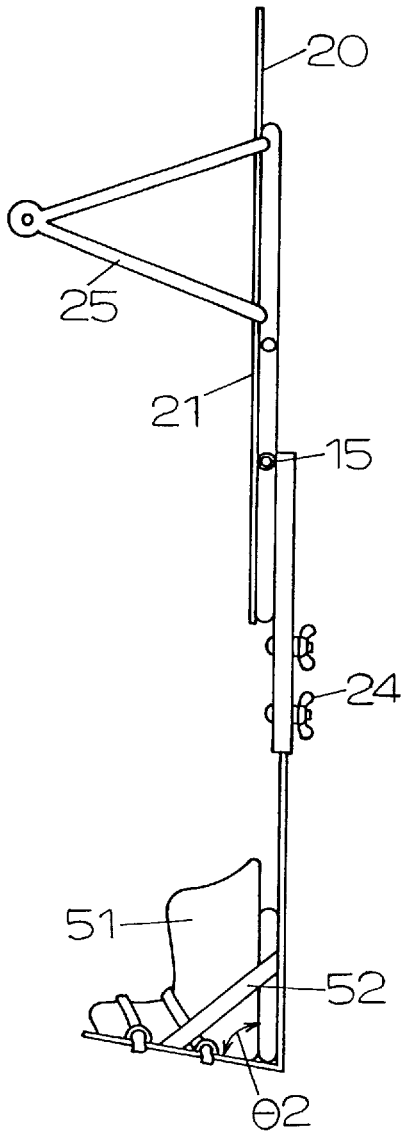
FIG. 5 is a side view of the carrier.

As shown in FIGS. 1 to 3, the gymnastic apparatus 1 comprises a fixed frame 10, a carrier 20 for carrying a body of a user, a rotary handle 30 to be operated by the user getting on the carrier, and a power transmission mechanism 40. The fixed frame 10 is formed in a cubic structure by the use of steel pipes 11 and joints 12 for coupling the steel pipes. The fixed frame 10 has a front entrance 13, from which the user can enter the gymnastic apparatus 1, and a pair of supporting rods 14 having first bearings 16 for rotatably supporting a main shaft 15 extending in a horizontal direction about its axis. As shown in FIGS. 4 and 5, the carrier 20 is formed with a movable frame 22 connected with the main shaft 15, a backboard 21 fixed to the movable frame, and a treadboard 23 extending from a bottom end of the carrier at an angle $\theta 2$ of approximately 80 degrees relative to the backboard. A foot holding unit 50 for holding feet of the user is mounted on the treadboard 23. The foot holding unit 50 comprises a pair of ski boots 51, and a belt 52 for tightly fixing the ski boots to the treadboard 23. The treadboard 23 is slidably supported to the backboard 21 to adjust a position of the treadboard according to height of the user. The treadboard 23 can be fixed to the backboard 21 by fixtures 24 such as bolts and nuts. Numeral 25 designates a pair of handle supporting frames projecting on the movable frame 22. In FIG. 4, numeral 26 designates a supporting shaft of a second sprocket explained later.

Figure 6:
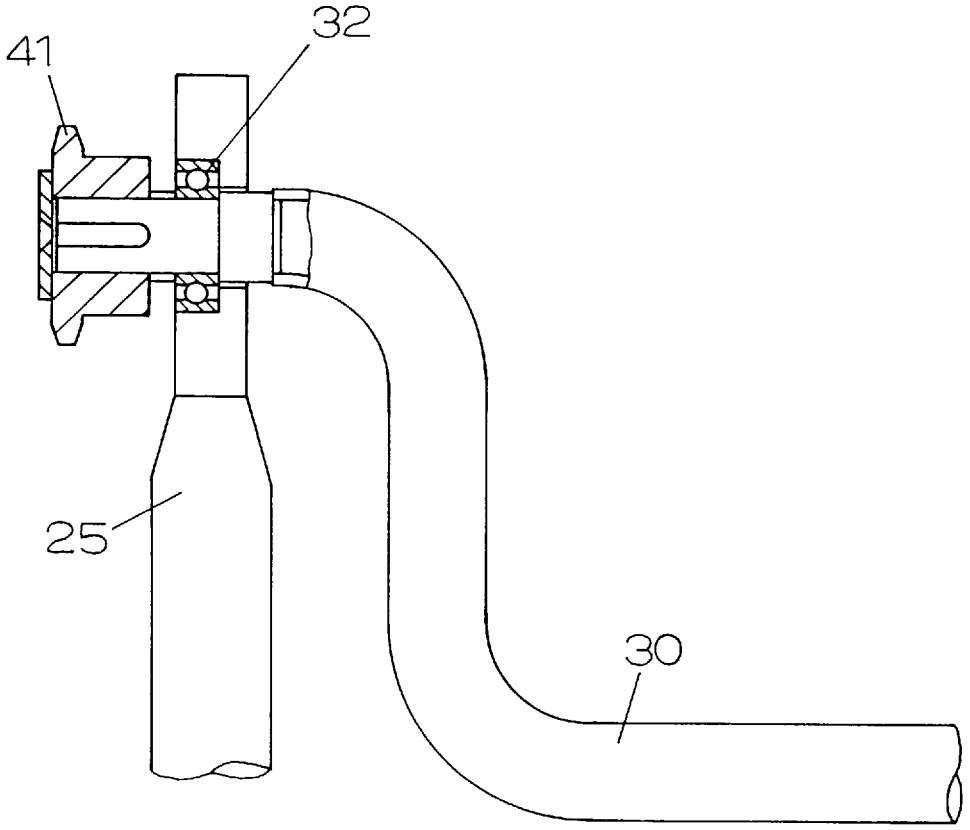
FIG. 6 is a partially cross-sectional view illustrating an end portion of a rotary handle of the gymnastic apparatus.
Figure 7:
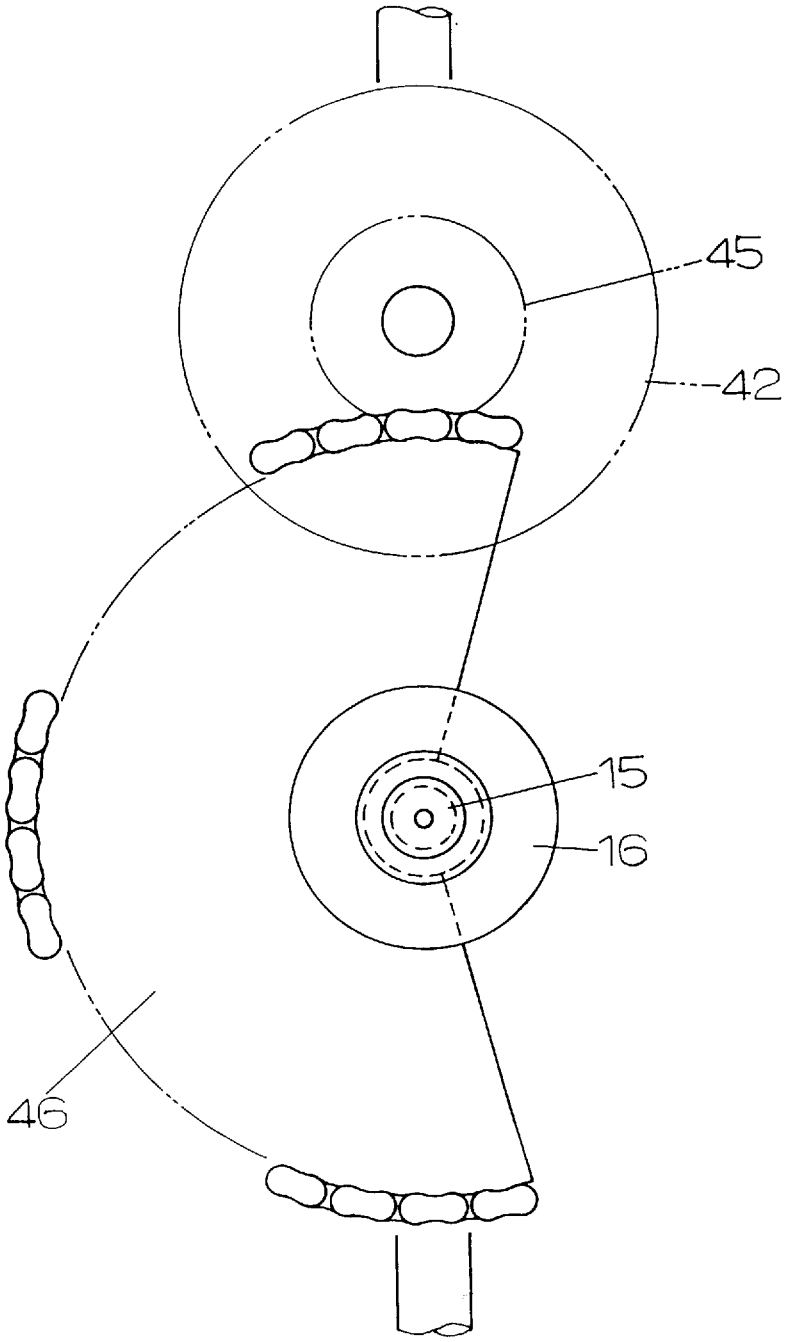
FIG. 7 is a front view of a power transmission mechanism of the gymnastic apparatus.
Figure 8:
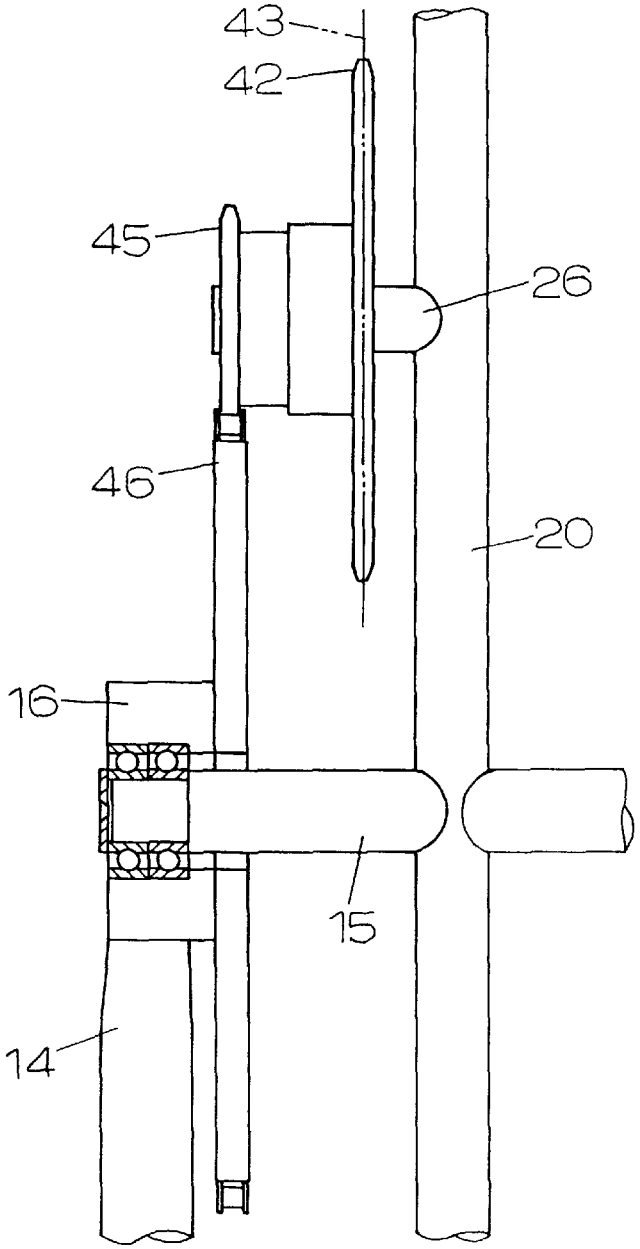
FIG. 8 is a side view of the power transmission mechanism.
Figure 9:
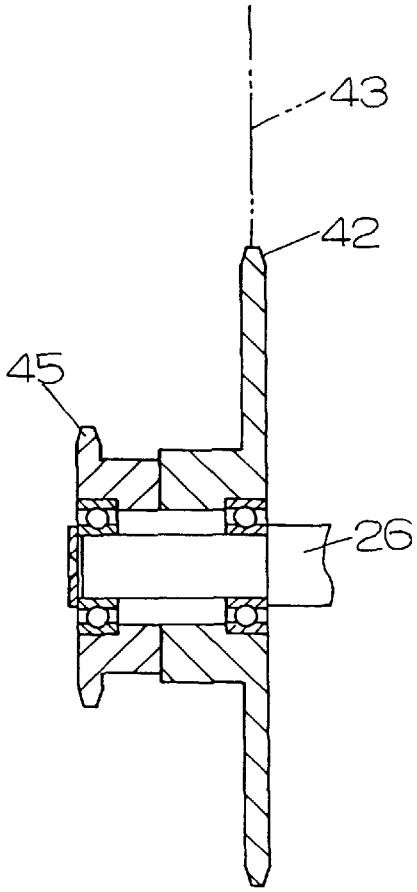
FIG. 9 is a cross-sectional view of second and third sprockets of the power transmission mechanism.

As shown in FIG. 6, the rotary handle 30 is supported to second bearings 32 mounted on the handle supporting frames 25 to be rotatable about a horizontal handle axis in opposite directions. The rotary handle 30 is in the form of a crank shaft which gives a rotary motion by a boating-like exercise by the user. The rotary handle 30 has grips 31 intermediate between axial ends thereof. The grips 31 of the rotary handle 30 are disposed in front of a breast portion of the user so as to be readily driven by the user getting on the carrier 20.

As shown in FIGS. 6 to 9, the power transmission mechanism 40 comprises a first sprocket 41 mounted on one end of the rotary handle 30, a second sprocket 42 rotatably supported to the supporting shaft 26 about its axis, a chain 43 connecting between the first and second sprockets, a third sprocket 45 integrally formed with the second sprocket and having a smaller diameter than the second sprocket, and a gear 46 formed on the main shaft 15 to engage with the third sprocket. A rotation of the rotary handle 30 is transmitted to the second sprocket 42 through the chain 43. The rotary motion of the second sprocket 42 is converted to a reduced rotary motion of the gear 46 through the third sprocket 45. The rotary motion of the gear 46 provides a rotary motion of the carrier 20 relative to the fixed frame 10 through the main shaft 15. Thus, the power transmission mechanism 40 can transmits the rotary motion of the rotary handle 30 to a reduced rotary motion of the carrier 20 relative to the fixed frame 10. Numeral 47 designate a cover of the gear 46 and the third sprocket 45. Numeral 48 designates a cover of the first and second sprockets (41, 42) and the chain 43. The fixed frame 10 is formed in a three-dimensional structure such that a rotational locus of the carrier 20 is within the fixed frame. In FIG. 1, numeral 17 designates a stopper for preventing an over rotation of the carrier 20.

Figure 10:
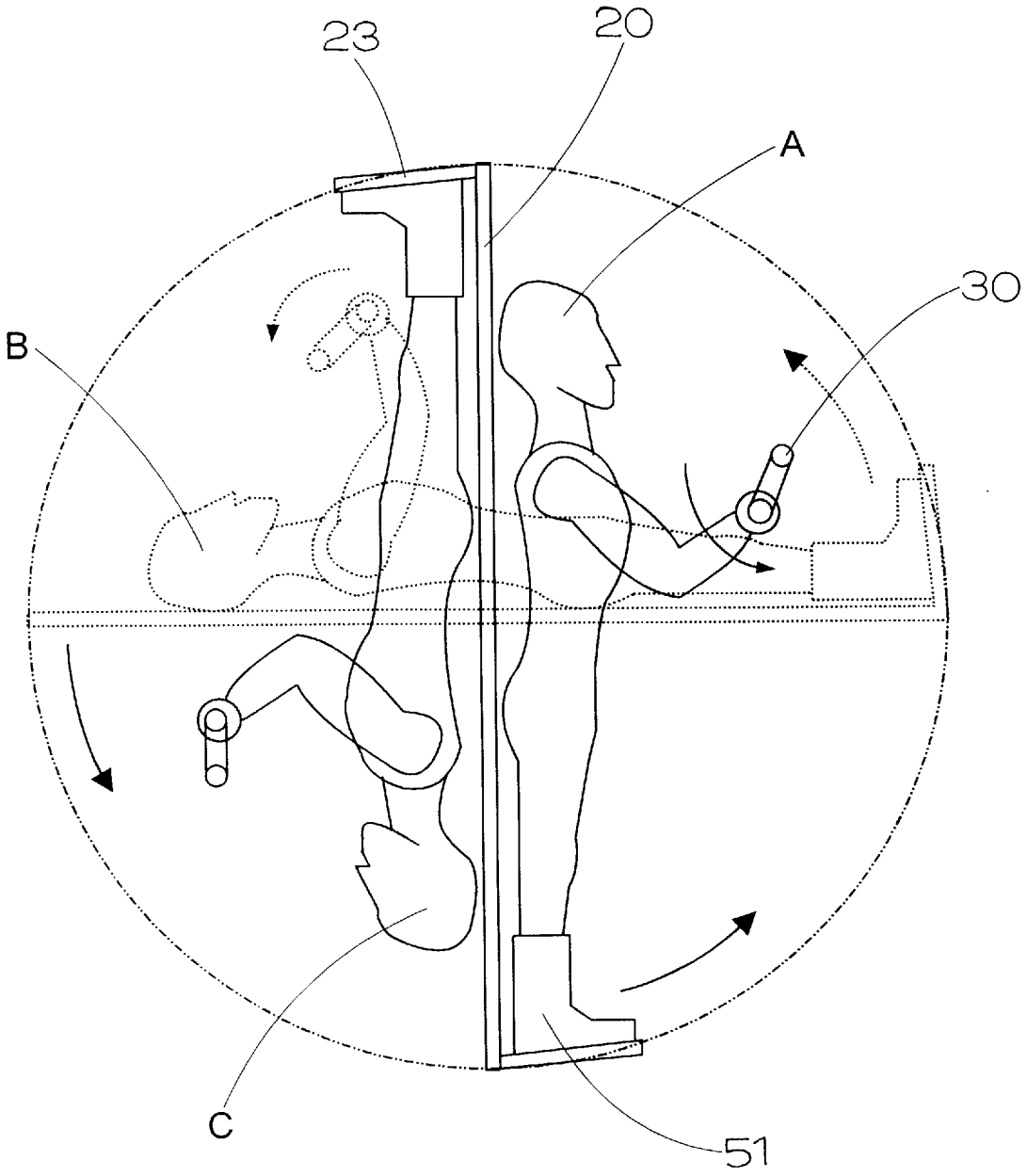
FIG. 10 is an explanatory diagram of illustrating a rotational action of the carrier.

As shown in FIG. 10, a physical exercise method using the gymnastic apparatus 1 comprises the steps of fixing feet of the user into the ski boots 51 of the foot holding unit 50, and rotating the rotary handle 30 in one direction to provide the rotary motion of the carrier 20 relative to the fixed frame 10 from a standing state (A), where the user stands upright with one's feet held by the ski boots, to an upside-down state (C), where the user is suspended one's head down with one's feet held by the ski-boots, through a horizontal state (B), as shown by a dotted line in FIG. 10. In this embodiment, the power transmission mechanism 40 is formed such that the 180° rotation of the carrier 20 from the standing state (A) to the upside-down state (C) is obtained by 8 times rotations of the rotary handle 30 by the boating-like exercise of the user. When a predetermined load is applied to the rotary handle 30, the boating-like exercise will provide an effective training of pectoralis major and latissimus dorsi of the user.

By the way, the ski boots 51 of the foot holding unit 50 are formed such that an ankle angle θ2 thereof is approximately 80 degrees. During the standing state (A), heels of the user contact insoles of the ski boots 51, so that an ankle angle of the user is substantially the same as the ankle angle θ2 of the ski boots. However, since the heels of the user are slightly kept away from the insoles of the ski boots 51 by terrestrial gravitation during the upside-down state (C), while insteps of the user being compressed, the user becomes to be suspended from the ski boots 51 at the ankle angle of approximately 90 degrees. This brings about a peripheral traction effect including a correction of pelvis of the user.

Thus, the user can take the upside-down state (C) all by oneself without help of others. After the upside-down state of the user is maintained for a required time period, the user can return the carrier 20 from the upside-down state (C) to the standing state (A) only by rotating the rotary handle 30 in the opposite direction.

Figure 11:
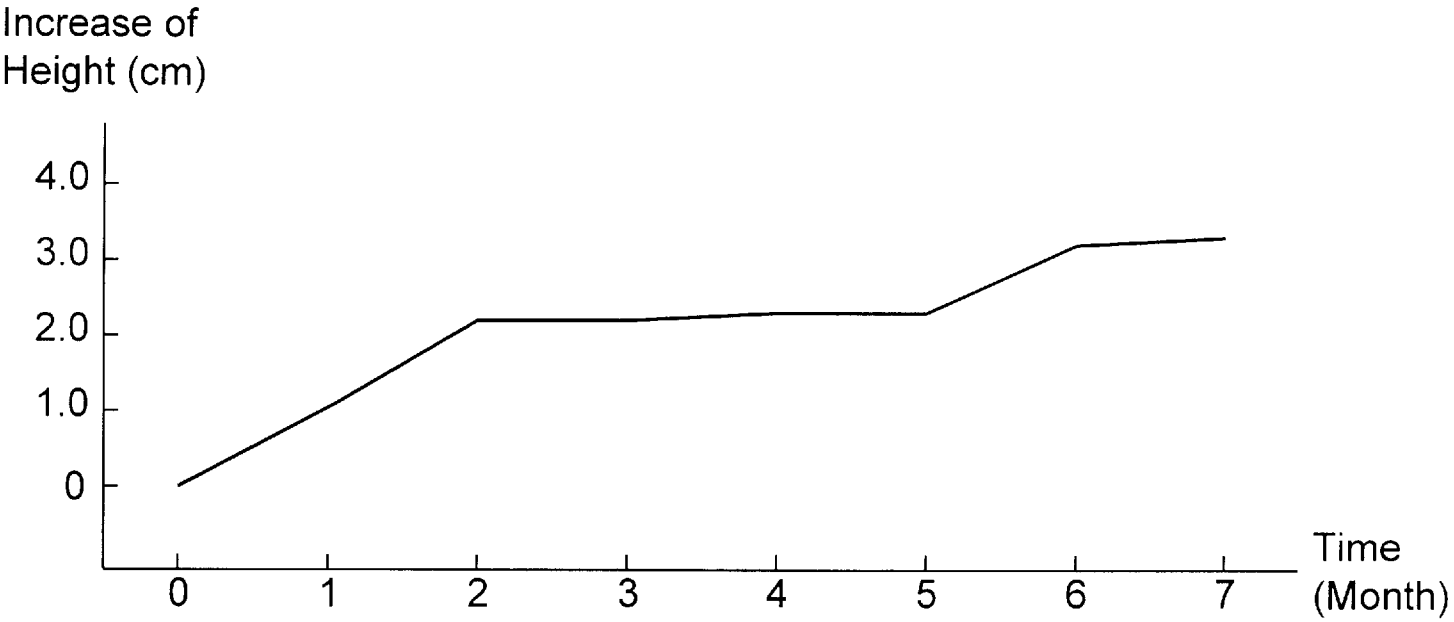
FIG. 11 is a graph showing an increase of height of a user using the gymnastic apparatus of the present invention.

FIG. 11 is a graph showing an interesting effect of the gymnastic apparatus 1. That is, the graph shows an increase of height of a user recorded for 7 months, in which 75 times physical exercises were done by the use of the gymnastic apparatus 1. The user is a male colleague student of 20 years old. When he was the first grade of a junior high school, a growth of his height had stopped. In each of the physical exercises, the user was maintained in the upside-down state for about 15 minutes. As a result of these exercises, the height of the user increases from 160.8 cm to 164.1 cm. Although there are variations in the effect of the gymnastic apparatus 1 in the individual case, this result suggests that the present gymnastic apparatus is effective to increase height of a user.

What is claimed is:

1. A health improving gymnastic apparatus comprising:

a fixed frame;

a carrier which carries a body of a user and includes foot holding means for holding feet of the user, said carrier provided with a main shaft by which said carrier is supported to said fixed frame so as to be rotatable about a horizontal axis of said main shaft relative to said fixed frame between a standing position, where the user stands upright with one's feet held by said foot holding means, and an upside-down position, where the user is suspended one's head down with one's feet held by said foot holding means, said main shaft carrying a gear thereon;

a rotary handle mounted on said carrier to extend horizontally between opposite sides of said carrier so as to be operated by the user on said carrier, said rotary handle being supported to bearings on said carrier to be rotatable about a horizontal handle axis in opposite directions and formed with a grip intermediate between axial ends thereof;

a sprocket formed on one end of said handle; and a speed reduction mechanism connecting said sprocket to said gear on said main shaft to transmit a rotary motion of said handle about the handle axis to a reduced rotary motion of said carrier relative to said fixed frame.

2. The gymnastic apparatus as set forth in claim 1, wherein said handle is in the form of a crank shaft such that said rotary motion about the horizontal axis is accomplished by the user rotating the handle with a motion that is similar to the rowing of a boat.

3. The gymnastic apparatus as set forth in claim 1, wherein said foot holding means has a first portion designed to rest against an ankle of a user and a second portion designed to support the foot of a user such that the angle between the first and the second portions is approximately 80 degrees.

4. The gymnastic apparatus as set forth in claim 1, wherein said fixed frame is formed in a three-dimensional structure such that a rotational locus of said carrier is within said fixed frame.

5. A physical exercise method using said gymnastic apparatus of claim 1 comprising the steps of:

holding said feet of the user to said foot holding means, and allowing the user to rotate said rotary handle to move said carrier from said standing position to an upside-down position, where the user is suspended one's head down with one's feet held by said foot holding means such that an ankle angle of the user is approximately 90 degrees.

* * * * *